US010544008B2

(12) United States Patent
Fauconnet et al.

(10) Patent No.: US 10,544,008 B2
(45) Date of Patent: Jan. 28, 2020

(54) SYSTEM TO ENABLE ACCESS TO TRAVELLING CABLE DEAD END HITCH FROM INSIDE AN ELEVATOR CAR

(71) Applicant: OTIS ELEVATOR COMPANY, Farmington, CT (US)

(72) Inventors: Aurelien Fauconnet, Isdes (FR); Frederic Beauchaud, Coullons (FR)

(73) Assignee: OTIS ELEVATOR COMPANY, Farmington, CT (US)

( * ) Notice: Subject to any disclaimer, the term of this patent is extended or adjusted under 35 U.S.C. 154(b) by 216 days.

(21) Appl. No.: 15/644,702

(22) Filed: Jul. 7, 2017

(65) Prior Publication Data

US 2018/0009635 A1 Jan. 11, 2018

(30) Foreign Application Priority Data

Jul. 11, 2016 (EP) ..... 16305871

(51) Int. Cl.
*B66B 7/12* (2006.01)
*B66B 5/00* (2006.01)
(Continued)

(52) U.S. Cl.
CPC ..... *B66B 7/12* (2013.01); *B66B 5/005* (2013.01); *B66B 7/064* (2013.01); *B66B 7/08* (2013.01); *B66B 9/00* (2013.01)

(58) Field of Classification Search
CPC ..... B66B 7/12; B66B 5/005; B66B 7/064; B66B 7/08; B66B 9/00
See application file for complete search history.

(56) References Cited

U.S. PATENT DOCUMENTS 1,822,153 A 9/1931 Kinnard
6,786,306 B2 9/2004 Tiner
(Continued)

FOREIGN PATENT DOCUMENTS

CN 202518906 U 11/2012
CN 103552897 A 2/2014
(Continued)

OTHER PUBLICATIONS

European Search Report and Written Opinion; European Application No. 16305871.2; International Filing Date: Jul. 11, 2016; dated Dec. 22, 2016; 8 pages.

*Primary Examiner* — Diem M Tran
(74) *Attorney, Agent, or Firm* — Cantor Colburn LLP

(57) ABSTRACT

A travelling cable end hitch and rail arrangement for an elevator system includes a rail assembly fixed to an elevator car of the elevator system, a movable device positioned at and movable along the rail assembly, and an end hitch portion of a travelling cable of the elevator system secured to the movable device and movable with the movable device along the rail assembly. A method of accessing a travelling cable end hitch of an elevator system includes accessing a travelling cable from inside of an elevator car, pulling the travelling cable upward from inside of the elevator car, moving an end hitch portion of the travelling cable along a rail assembly secured to a bottom of the elevator car via pulling the travelling cable upward, and inspecting the end hitch portion from inside the elevator car when the end hitch portion reaches a first end of the rail assembly.

14 Claims, 6 Drawing Sheets

(51) Int. Cl.

| | |
|---|---|
| ***B66B 7/06*** | (2006.01) |
| ***B66B 7/08*** | (2006.01) |
| ***B66B 9/00*** | (2006.01) |

(56) References Cited

U.S. PATENT DOCUMENTS

| | | | | |
|---|---|---|---|---|
| 8,316,998 | B2 * | 11/2012 | Henseler | B66B 11/0246 187/317 |
| 8,807,286 | B2 | 8/2014 | Puranen et al. | |
| 2002/0104715 | A1 | 8/2002 | Zaharia et al. | |
| 2014/0182974 | A1 | 7/2014 | Puranen et al. | |
| 2014/0353091 | A1 | 12/2014 | Fauconnet et al. | |
| 2015/0246792 | A1 * | 9/2015 | Baltis | B66B 11/0246 187/276 |

FOREIGN PATENT DOCUMENTS

| | | | |
|---|---|---|---|
| CN | 104229581 | A | 12/2014 |
| JP | 7206320 | A | 9/1931 |
| JP | 223187 | A | 1/1990 |
| JP | 753158 | A | 2/1995 |
| JP | 11335035 | A | 12/1999 |
| JP | 2001270670 | A | 10/2001 |
| JP | 2001294380 | A | 10/2001 |
| JP | 2005231794 | A | 9/2005 |
| JP | 2005350214 | A | 12/2005 |
| JP | 4526647 | B2 | 8/2010 |
| JP | 5996593 | B2 * | 9/2016 |
| WO | 2015022737 | A1 | 2/2015 |
| WO | 2015126378 | A1 | 8/2015 |

* cited by examiner

SYSTEM TO ENABLE ACCESS TO TRAVELLING CABLE DEAD END HITCH FROM INSIDE AN ELEVATOR CAR

CROSS-REFERENCE TO RELATED APPLICATIONS

This application claims the benefit of European Patent Application No. 16305871.2 filed on Jul. 11, 2016, which is incorporated herein by reference in its entirety.

BACKGROUND

The subject matter disclosed herein relates to elevator systems. More particularly, the present disclosure relates to inspection and maintenance of travelling cables for an elevator system.

Elevator systems typically include one or more elevator cars movable along a hoistway. To provide electrical power for lighting and sound, communications, and other functions such as connections between a car operating panel and the control system of the elevator system which is located generally inside the hoistway, a travelling cable is located in the hoistway with one end connected to, for example, the control system, and another end operably connected to the elevator car.

The travelling cable must be periodically inspected for conditions such as wear or shorts, and/or the travelling cable is replaced when needed. In current systems, portions of the travelling cable are inspected by maintenance personnel entering the hoistway and accessing the travelling cable from the top of the elevator car. Still other portions of the travelling cable, such as the portion below the elevator car, are only accessible for inspection by maintenance personnel entering the pit at the bottom of the hoistway. It is desired, however, to perform maintenance operations from inside of the car, and eliminate the need for maintenance personnel to enter the hoistway pit and consequently suppress the need for a safety volume and advantageously reduce the hoistway impact on the building thus saving space.

SUMMARY

In one embodiment, a travelling cable end hitch and rail arrangement for an elevator system includes a rail assembly fixed to an elevator car of the elevator system, a movable device positioned at and movable along the rail assembly, and an end hitch portion of a travelling cable of the elevator system secured to the movable device and movable with the movable device along the rail assembly.

Additionally or alternatively, in this or other embodiments the rail assembly slopes downwardly with increasing distance from a first end of the rail assembly nearest a sidewall of the elevator car.

Additionally or alternatively, in this or other embodiments the rail assembly slopes downwardly linearly, curvilinearly or a combination of linearly and curvilinearly.

Additionally or alternatively, in this or other embodiments the rail assembly is positioned below a floor of the elevator car.

Additionally or alternatively, in this or other embodiments a movable device stop is located at an end of the rail assembly.

Additionally or alternatively, in this or other embodiments the rail assembly includes two rails with the movable device extending between the two rails.

Additionally or alternatively, in this or other embodiments the travelling cable end hitch portion is wrapped around the movable device.

In another embodiment, a method of accessing a travelling cable end hitch of an elevator system includes accessing a travelling cable from inside of an elevator car, pulling the travelling cable upward from inside of the elevator car, moving an end hitch portion of the travelling cable along a rail assembly secured to a bottom of the elevator car via pulling the travelling cable upward, and inspecting the travelling cable end hitch portion from inside of the elevator car when the travelling cable end hitch portion reaches a first end of the rail assembly.

Additionally or alternatively, in this or other embodiments the travelling cable end hitch portion is secured to a movable device disposed at the rail assembly, and the travelling cable end hitch portion is moved along the rail assembly via the movable device positioned at the rail assembly.

Additionally or alternatively, in this or other embodiments the end hitch portion is wrapped around the movable device.

Additionally or alternatively, in this or other embodiments an access opening in a sidewall of the elevator car is opened, and a travelling cable is accessed via the access opening.

Additionally or alternatively, in this or other embodiments the travelling cable end hitch portion is replaced at the first end of the rail assembly, the travelling cable is released, and the travelling cable end hitch portion is allowed to move from the first end to a second end of the rail assembly opposite the first end.

In yet another embodiment, an elevator system includes a hoistway, a travelling cable located in the hoistway, and an elevator car movable along the hoistway and operably connected to the travelling cable. The elevator car includes an elevator car floor, a rail assembly located below the floor, a movable device located at and movable along the rail assembly. An end hitch portion of the travelling cable is secured to the movable device and movable therewith.

Additionally or alternatively, in this or other embodiments the rail assembly slopes downwardly with increasing distance from a first end of the rail assembly nearest a sidewall of the elevator car and the slope is one of linear, curvilinear or a combination of linear and curvilinear.

Additionally or alternatively, in this or other embodiments a movable device stop is located at a second end of the rail assembly.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

DETAILED DESCRIPTION

Figure 1:
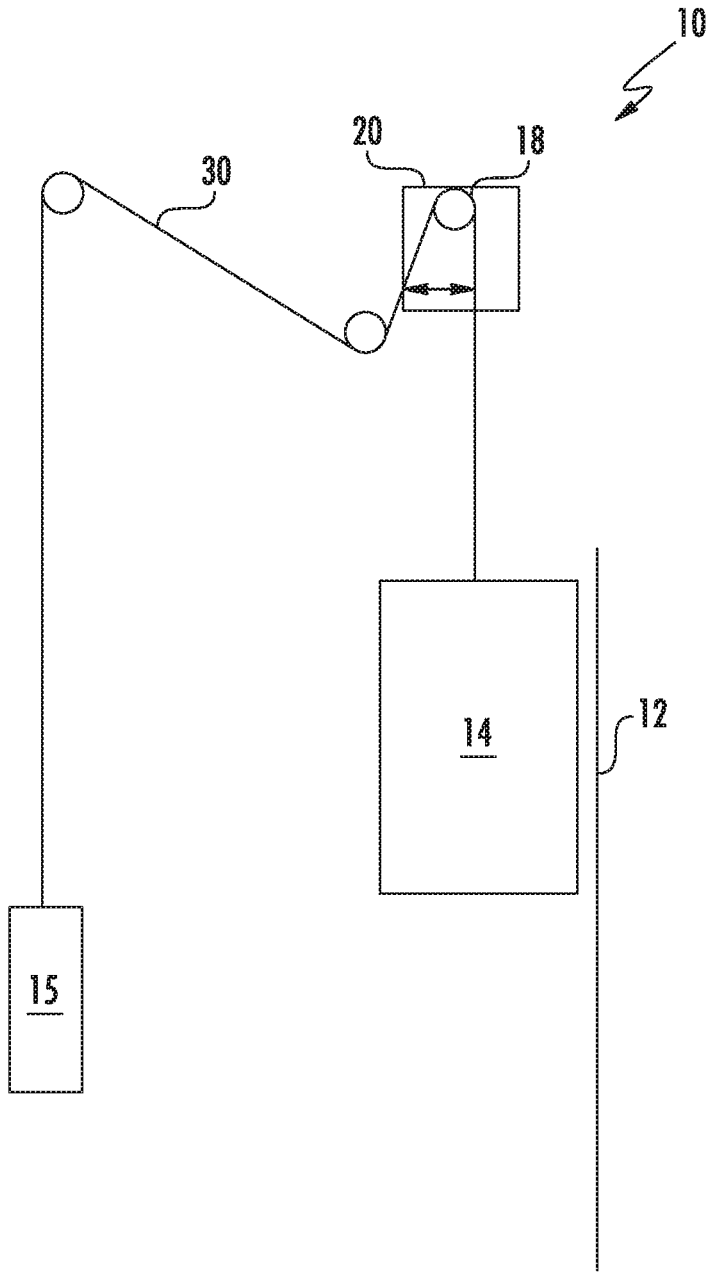
FIG. 1 is a schematic view of an embodiment of an elevator system.

Referring now to FIG. 1, an exemplary embodiment of an elevator system 10 is illustrated. The elevator system 10 includes an elevator car 14 configured to move vertically upwardly and downwardly within a hoistway 12 along a plurality of car guide rails (not shown). Guide assemblies (not shown) mounted to the top and bottom of the elevator car 14 are configured to engage the car guide rails to maintain proper alignment of the elevator car 14 as it moves within the hoistway 12.

The elevator system 10 also includes a counterweight 15 configured to move vertically upwardly and downwardly within the hoistway 12. The counterweight 15 moves in a direction generally opposite the movement of the elevator car 14 as is known in conventional elevator systems. Movement of the counterweight 15 is guided by counterweight guide rails (not shown) mounted within the hoistway 12. In the illustrated, non-limiting embodiment, at least one load bearing member 30, for example, a belt or a rope is coupled to both the elevator car 14 and the counterweight 15 and cooperates with a drive sheave 18 mounted to a drive machine 20. Thus, the elevator car 14 and the counterweight 15 are moved upwardly and downwardly along the hoistway 12.

Figure 2:
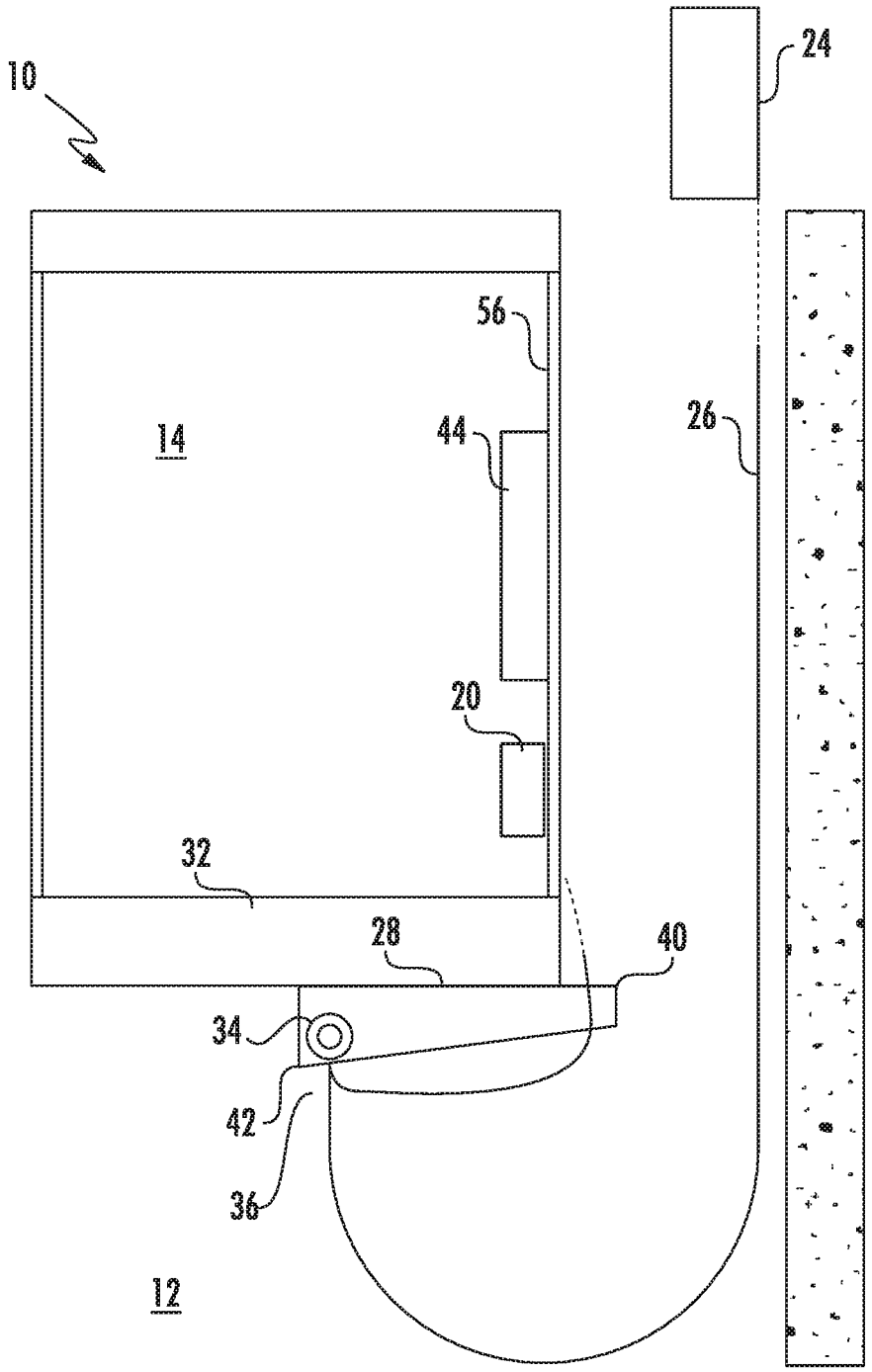
FIG. 2 is a another schematic view of an elevator system including a travelling cable.

Referring to FIG. 2, the elevator system 10 further includes a travelling cable 26 positioned in the hoistway 12 connecting the elevator car 14 to an elevator control system 24 via, for example, a car operating panel 22 in the elevator car 14. Further, the travelling cable 26 may be utilized to provide electrical power and/or communications to the elevator car 14. The travelling cable 26 is to be periodically inspected, and it desired to inspect the travelling cable from inside the elevator car 14 as will be described in the following.

Figure 3:
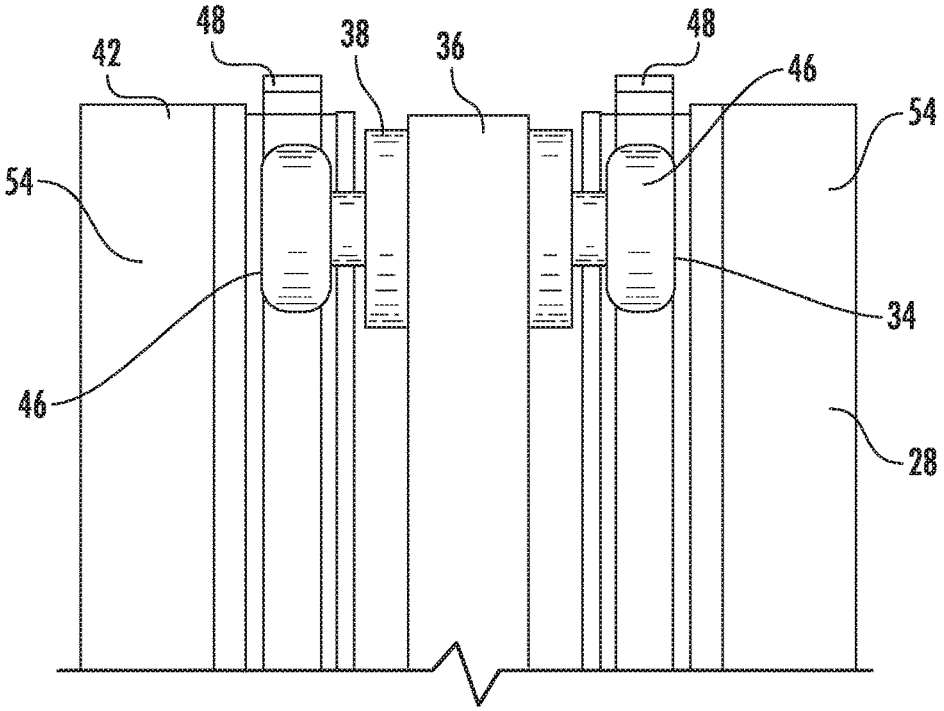
FIG. 3 is a plan view of an embodiment of a rail assembly for a travelling cable end hitch.

A rail assembly 28 is fixed to the elevator car 14 below an elevator car floor 32. A movable device, such as a roller 34 is positioned at the rail assembly 28 to be movable along the rail assembly 28 be either rolling or sliding and an end hitch portion 36 of the travelling cable 26 is connected to the roller 34 by, for example, wrapping the end hitch portion 36 around a roller axle 38, as shown in FIG. 3. While a roller 34 is shown in FIG. 2 and described herein, one skilled in the art will readily appreciate that other elements, such as a sliding pad, may be utilized in place of or in addition to the roller 34 to move along the rail assembly 28.

Referring again to FIG. 2, the rail assembly has a first rail end 40 and a second rail end 42, positioned such that the first rail end 40 is located nearest an access opening 44 at, for example, a sidewall 56 of the elevator car 14. The rail assembly 28 further slopes downwardly from the first rail end 40 to the second rail end 42. In some embodiments, such as in FIG. 2, the slope is linear, while in other embodiments the slope may be curvilinear or a combination of linear and curvilinear.

Referring to FIG. 3, in some embodiments the rail assembly 28 includes two rails 54, with the roller 34 having two roller wheels 46. In these embodiments, each roller wheel 46 is located in a rail 54 with the roller axle 38 extending between the rails 54. The travelling cable 36 is fixed to the roller axle 38 via, for example, a collar (not shown).

Figure 4:
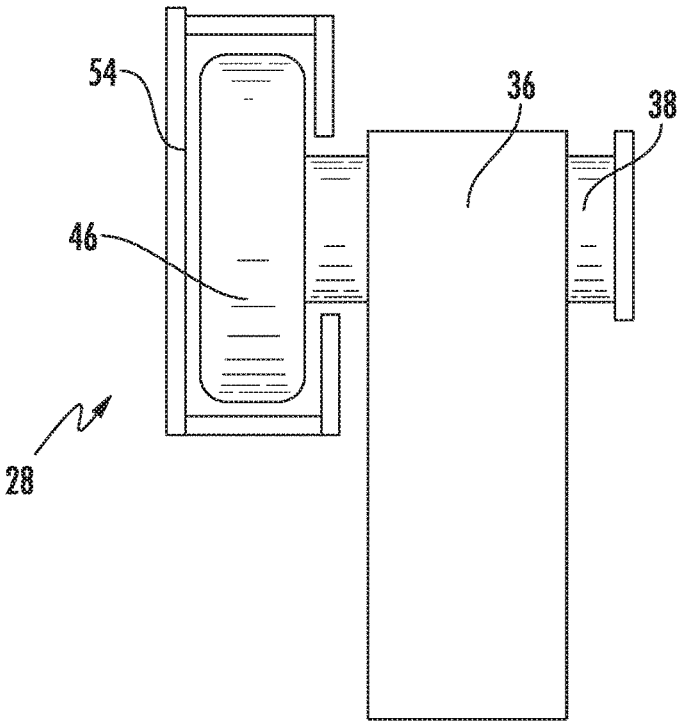
FIG. 4 is a cross-sectional view of an embodiment of a rail assembly for a travelling cable end hitch.

In another embodiment, as shown in FIG. 4, the rail assembly 28 has a single rail 54 with a cross-section, for example a C-shaped cross-section, configured to retain a roller wheel 46 or sliding pad therein, with the roller axle 38 extending outwardly from the rail 54. Referring again to FIG. 3, the rail assembly 28 further includes a roller stop 48 located at the second rail end 42 to prevent the roller 34 from falling from the second rail end 42. The travelling cable 36 is fixed to the roller axle 38 via, for example, a collar (not shown).

Figure 5:
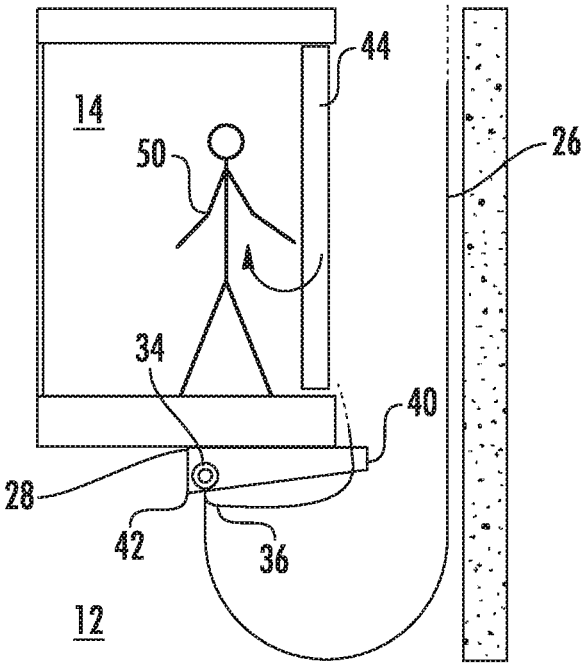
FIGS. 5-9 illustrate operation of a rail assembly for a travelling cable end hitch.
Figure 6:
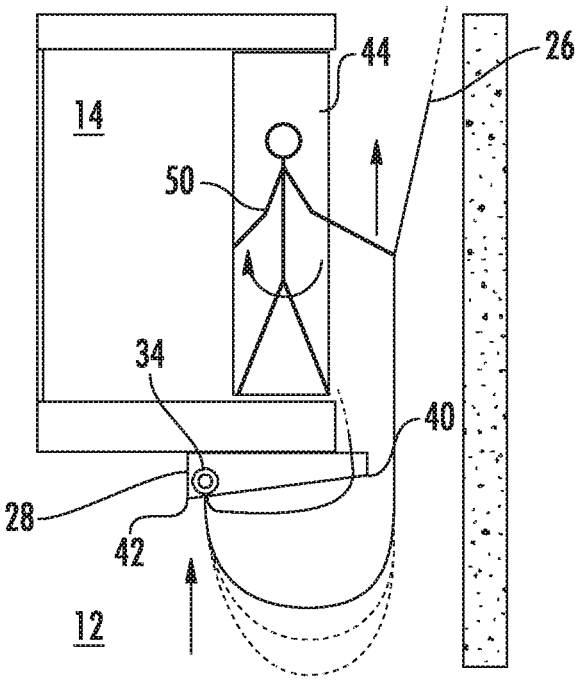

Referring to FIGS. 5-9, operation of the rail assembly 28 for inspection and/or maintenance of the travelling cable 26 will now be described. As shown in FIG. 5, during normal operation of the elevator system 10, the roller 34 is located at or near the second rail end 42 via gravitational forces acting on the travelling cable 26 and the roller 34 and the slope of the rail 54. For inspection and/or maintenance, the elevator car 14 is preferably driven to a bottom level of the hoistway 12, and the access opening 44 is opened by, for example, opening a panel (not shown) in the elevator car 14. Referring to FIG. 6, a maintenance technician 50 in the elevator car 14 accesses the travelling cable 26 via the access opening 44 and begins pulling the travelling cable upwardly.

Figure 7:
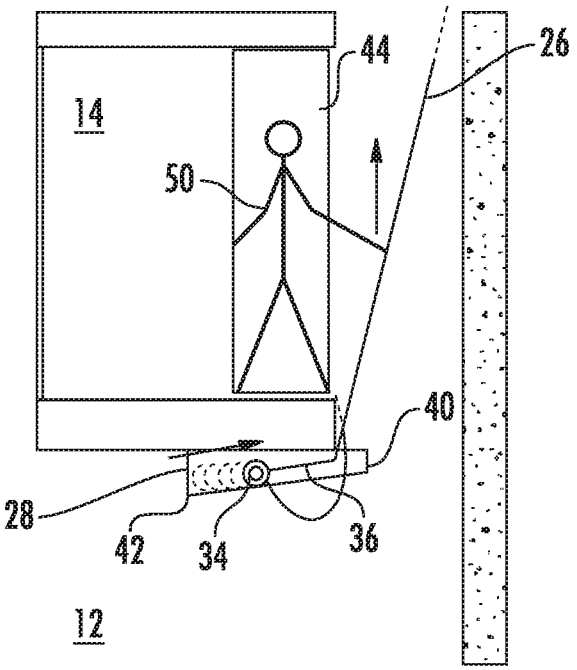
Figure 8:
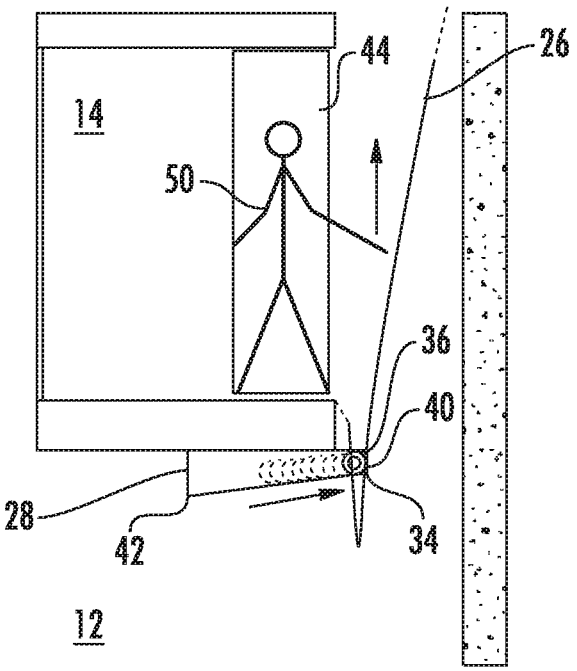
Figure 9:
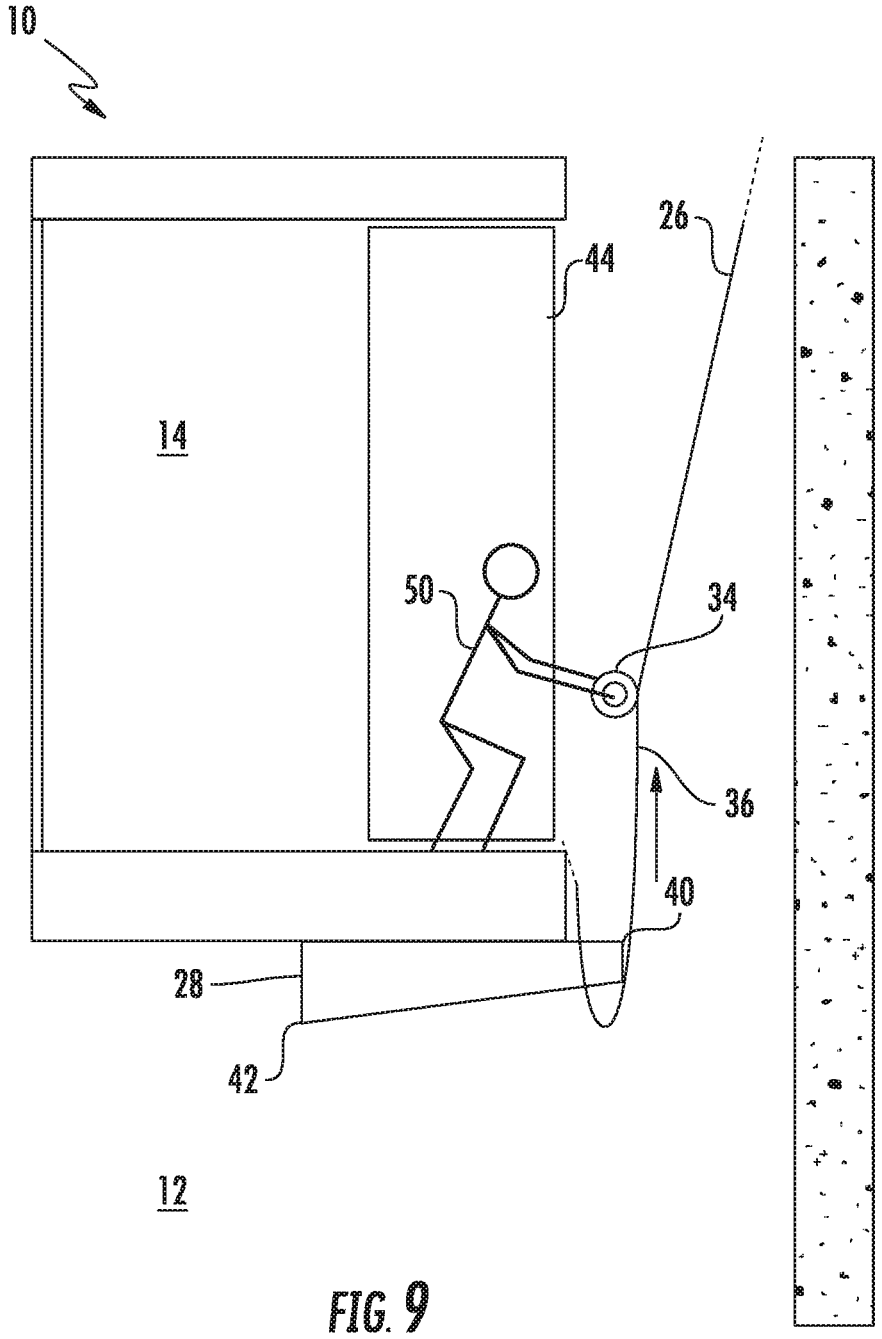

As shown in FIG. 7, as the maintenance technician 50 continues to pull the travelling cable 26 upwardly, the roller 34 and the end hitch portion 36 are moved along the rail assembly 28 from the second rail end 42 toward the first rail end 40, until as shown in FIG. 8, the roller 34 reached the first rail end 40. Referring now to FIG. 9, once the roller 34 has reached the first rail end 40, the maintenance technician 50 may remove the roller 34 from the rail assembly 28 to inspect the end hitch portion 36 of the travelling cable 26 while inside the elevator car 14. When the inspection and/or maintenance operation is completed, the roller 34 is replaced at the first rail end 40 and the travelling cable 26 is released, allowing the roller 34 or sliding pads, and end hitch portion 36 to return to the second rail end 42. In some embodiments, as shown in FIG. 9, the first rail end 40 protrudes from the sidewall 46 of the elevator car 14, to improve ease of removing the roller 34 from the rail assembly 28 and replacing the roller 34 at the rail assembly 28.

The apparatus and method described herein allow for inspection and/or maintenance of the travelling cable 26, including the end hitch portion 36, from inside of the elevator car 14. This improves maintenance worker safety by eliminating a need to enter the hoistway pit to perform this maintenance task, and consequently reduces a need for a safety volume and advantageously reduces the hoistway impact on the building by saving space.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions or equivalent arrangements not heretofore described, but which are commensurate in spirit and/or scope. Additionally, while various embodiments have been described, it is to be understood that aspects of the present disclosure may include only some of the described embodiments. Accordingly, the present disclosure is not to be seen as limited by the foregoing description, but is only limited by the scope of the appended claims.

What is claimed is:

1. A travelling cable end hitch and rail arrangement for an elevator system, comprising:

a rail assembly fixed to an elevator car of the elevator system;

a movable device disposed at and movable along the rail assembly; and an end hitch portion of a travelling cable of the elevator system secured to the movable device and movable with the roller along the rail assembly;

wherein the rail assembly slopes downwardly with increasing distance from a first end of the rail assembly nearest a sidewall of the elevator car, the first rail end protruding from the sidewall of the elevator car to improve ease of removing the movable device from the rail assembly from inside of the elevator car.

2. The travelling cable end hitch and rail arrangement of claim 1, wherein the rail assembly slopes downwardly linearly, curvilinearly or a combination of linearly and curvilinearly.

3. The travelling cable end hitch and rail arrangement of claim 1, wherein the rail assembly is disposed below a floor of the elevator car.

4. The travelling cable end hitch and rail arrangement of claim 1, further comprising a movable device stop at an end of the rail assembly.

5. The travelling cable end hitch and rail arrangement of claim 1, wherein the rail assembly includes two rails with the movable device extending between the two rails.

6. The travelling cable end hitch and rail arrangement of claim 1, wherein the travelling cable end hitch portion is wrapped around the movable device.

7. A method of accessing a travelling cable end hitch of an elevator system, comprising:

accessing a travelling cable from inside of an elevator car;

pulling the travelling cable upward from inside of the elevator car;

moving an end hitch portion of the travelling cable along a rail assembly secured to a bottom of the elevator car via pulling the travelling cable upward; and inspecting the travelling cable end hitch portion from inside of the elevator car when the travelling cable end hitch portion reaches a first end of the rail assembly;

wherein the rail assembly slopes downwardly with increasing distance from a first end of the rail assembly nearest a sidewall of the elevator car, the first rail end protruding from the sidewall of the elevator car to improve ease of removing the travelling cable end hitch portion from the rail assembly from inside of the elevator car.

8. The method of claim 7, further comprising:

securing the travelling cable end hitch portion to a movable device disposed at the rail assembly; and moving the travelling cable end hitch portion along the rail assembly via the movable device disposed at the rail assembly.

9. The method of claim 8, wherein the end hitch portion is wrapped around the movable device.

10. The method of claim 7, further comprising:

opening an access opening in a sidewall of the elevator car; and accessing a travelling cable via the access opening.

11. The method of claim 7, further comprising:

replacing the travelling cable end hitch portion at the first end of the rail assembly;

releasing the travelling cable; and allowing the travelling cable end hitch portion to move from the first end to a second end of the rail assembly opposite the first end.

12. An elevator system comprising:

a hoistway;

a travelling cable disposed in the hoistway; and an elevator car movable along the hoistway and operably connected to the travelling cable, the elevator car including:

an elevator car floor;

a rail assembly disposed below the floor;

a movable device disposed at and movable along the rail assembly; and an end hitch portion of the travelling cable secured to the movable device and movable therewith;

wherein the rail assembly slopes downwardly with increasing distance from a first end of the rail assembly nearest a sidewall of the elevator car, the first rail end protruding from the sidewall of the elevator car to improve ease of removing the movable device from the rail assembly from inside of the elevator car.

13. The elevator system of claim 12, wherein the rail assembly slopes downwardly with increasing distance from a first end of the rail assembly nearest a sidewall of the elevator car, and wherein the slope is one of linear, curvilinear or a combination of linear and curvilinear.

14. The elevator system of claim 12, further comprising a movable device stop at a second end of the rail assembly.

* * * * *